US009413058B1

(12) United States Patent
Kuo et al.

(10) Patent No.: US 9,413,058 B1
(45) Date of Patent: Aug. 9, 2016

(54) LOOP-FEEDING WIRELESS AREA NETWORK (WAN) ANTENNA FOR METAL BACK COVER

(71) Applicant: Amazon Technologies, Inc., Reno, NV (US)

(72) Inventors: Jerry Weiming Kuo, San Jose, CA (US); Adrian Napoles, Cupertino, CA (US); Ming Zheng, Cupertino, CA (US); Khaled Ahmad Obeidat, Santa Clara, CA (US)

(73) Assignee: Amazon Technologies, Inc., Seattle, WA (US)

( * ) Notice: Subject to any disclaimer, the term of this patent is extended or adjusted under 35 U.S.C. 154(b) by 0 days.

(21) Appl. No.: 14/796,040

(22) Filed: Jul. 10, 2015

(51) Int. Cl.
*H01Q 1/24* (2006.01)
*H01Q 5/335* (2015.01)

(52) U.S. Cl.
CPC ..... *H01Q 1/243* (2013.01); *H01Q 5/335* (2015.01)

(58) Field of Classification Search
CPC ..... H01Q 1/36; H01Q 5/00; H01Q 5/10; H01Q 5/20; H01Q 5/30; H01Q 5/314; H01Q 5/328; H01Q 5/357; H01Q 7/00
See application file for complete search history.

(56) References Cited

U.S. PATENT DOCUMENTS

2005/0259013 A1* 11/2005 Gala Gala ..... H01Q 1/243 343/702
2006/0181468 A1* 8/2006 Iguchi ..... H01Q 1/243 343/702
2014/0354484 A1* 12/2014 Kashiwagi ..... H01Q 9/42 343/700 MS

* cited by examiner

*Primary Examiner* — Nguyen Vo
(74) *Attorney, Agent, or Firm* — Lowenstein Sandler LLP

(57) ABSTRACT

Antenna structures and methods of operating the same are described. One apparatus includes a metal cover having a first corner portion, a second corner portion, and an elongated portion. The elongated portion is physically separated from the first corner portion by a first cutout in the metal cover and the elongated portion is physically separated from the second corner portion by a second cutout in the metal cover. A radio frequency (RF) circuit is coupled to a feeding element that is coupled to the elongated portion. A capacitor is coupled between the feeding element and the first corner portion near the distal end of the feeding element. The RF circuit is operable to cause the feeding element, the elongated portion, and the first corner portion to radiate electromagnetic energy as a first radiator in a first frequency range with dual resonance.

20 Claims, 8 Drawing Sheets

Original Monopole as a Proximity Sensor
Radiation is reduced as current cancels

~2pF cap to match RF and block DC to
keep proximity sensor signal quality

600

LOOP-FEEDING WIRELESS AREA NETWORK (WAN) ANTENNA FOR METAL BACK COVER

BACKGROUND

A large and growing population of users is enjoying entertainment through the consumption of digital media items, such as music, movies, images, electronic books, and so on. The users employ various electronic devices to consume such media items. Among these electronic devices (referred to herein as user devices) are electronic book readers, cellular telephones, personal digital assistants (PDAs), portable media players, tablet computers, netbooks, laptops and the like. These electronic devices wirelessly communicate with a communications infrastructure to enable the consumption of the digital media items. In order to wirelessly communicate with other devices, these electronic devices include one or more antennas.

BRIEF DESCRIPTION OF DRAWINGS

The present inventions will be understood more fully from the detailed description given below and from the accompanying drawings of various embodiments of the present invention, which, however, should not be taken to limit the present invention to the specific embodiments, but are for explanation and understanding only.

DETAILED DESCRIPTION

Figure 1A:
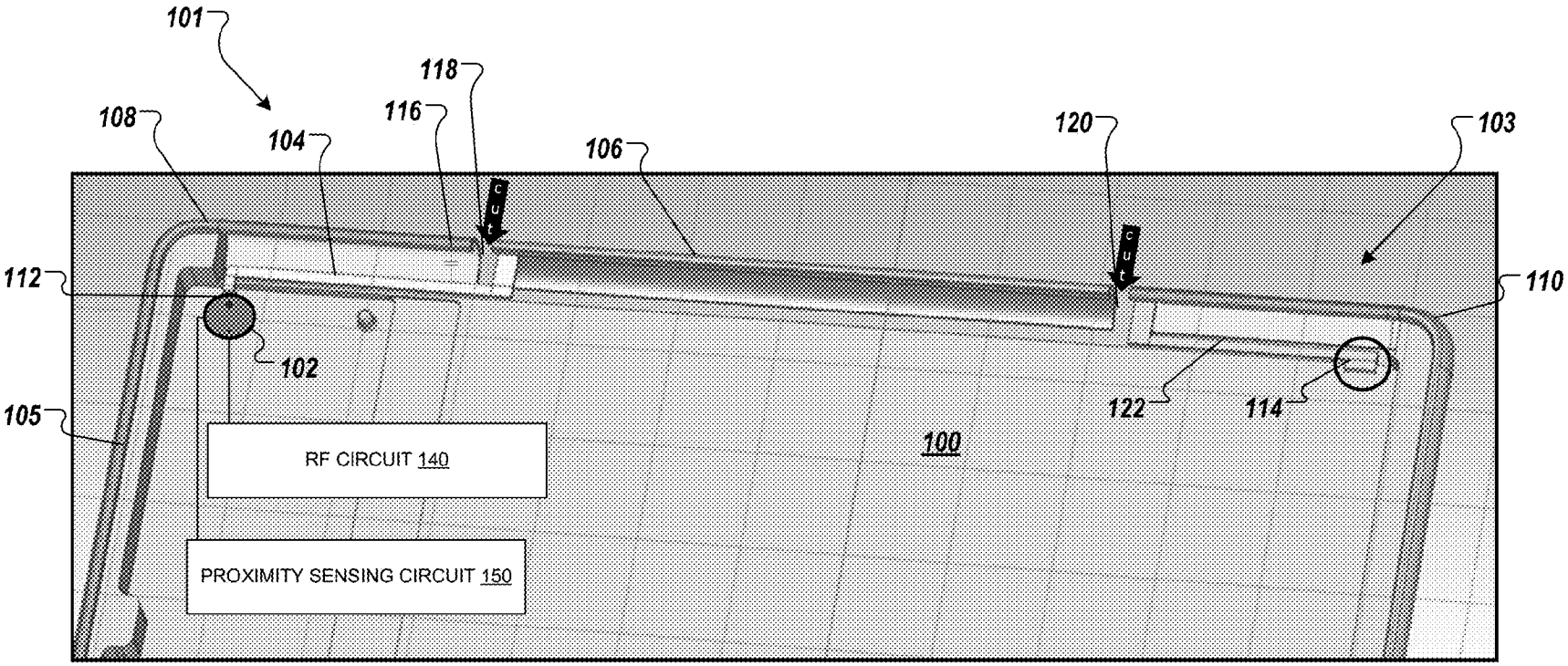
FIG. 1A is a diagram of an antenna architecture of a user device with a low-band feeding structure and a high-band parasitic structure according to one embodiment.

Antenna structures and methods of operating the same are described. One apparatus includes a metal cover having a first corner portion, a second corner portion, and an elongated portion. The elongated portion is physically separated from the first corner portion by a first cutout in the metal cover and the elongated portion is physically separated from the second corner portion by a second cutout in the metal cover. A radio frequency (RF) circuit is coupled to a feeding element that is coupled to the elongated portion. A capacitor is coupled between the feeding element and the first corner portion near the distal end of the feeding element. The RF circuit is operable to cause the feeding element, the elongated portion, and the first corner portion to radiate electromagnetic energy as a first radiator in a first frequency range with dual resonance. As described herein, the first radiator has a first resonant mode and a second resonant mode, resulting in the dual resonance.

The embodiments described herein are directed to WAN antennas that can use the metal cover, such as back cover. Mobile devices with a metal back cover typically cannot use both corner areas for efficient radiation. These conventional antennas require slot cutouts nearby the corners. The embodiments described herein can utilize the corners of the metal cover as low band and high band radiators, respectively without cutouts nearby the corners as done conventionally. With the preservation of the connected corners, consequently, the metal structure enhances the reliability of the mobile devices. The low band feeding structure can have a unique loop ground feeding structure, as described in more detail below. This feeding structure utilizes the corner ground element to cause a loop curve that goes inward in the smith chart described and illustrated herein. This cause a dual resonance for the low band radiator. The dual resonance causes a wideband dual resonance at the low band in a limited antenna volume without matching components as described herein. The embodiments described herein utilize the corners to give effective radiation and provide bandwidth without matching components. The embodiments described herein can also utilize a middle strip of the low band resonator as a long isolated bar for a proximity sensor. That is, the elongated portion of the antenna structure can be repurposed as a proximity sensor. The elongated structure can be considered a capacitor of which the capacitance can be measured by proximity sensing circuitry. This permits a proximity sensor and an antenna to be integrated into the same structure of the user device.

Several topologies of 2G/3G WAN antenna structures are contemplated herein. One antenna structure involves a two-cutout design with a middle portion (also described herein as an elongated portion) and two corner areas that are robustly connected to a chassis of the metal cover. This design can also reuse the antenna structure as a proximity sensor. The antenna structure exhibits good efficiency and may account for lossy materials such as inductors, caps, plastic, touch traces, ink, indium-tin-oxide (ITO) traces, or the like.

The antenna structures described herein can be used for wireless area network (WAN) technologies, such as cellular technologies including Long Term Evolution (LTE) frequency bands, third generation (3G) frequency bands, Wi-Fi® and Bluetooth® frequency bands or other wireless local area network (WLAN) frequency bands, global navigation satellite system (GNSS) frequency bands (e.g., positioning system (GPS) frequency bands, or the like.

FIG. 1A is a diagram of an antenna architecture of a user device 100 with a low-band feeding structure 101 and a high-band parasitic structure 103 according to one embodiment. The user device 100 includes a RF circuit 140 (also referred to herein as RF chipset and RF circuitry), a single RF feed 102, the low-band feeding structure 101, and the high-band parasitic structure 103. The low-band feeding structure 101 includes a feeding element 104, a middle strip element 106, and a first corner ground element 108. A capacitor 116 is disposed between the first corner ground element 108 and the feeding element 104. The low-band feeding structure 101 is a dual-resonance structure in a first frequency range (e.g., low band).

The user device 100 includes a metal cover 105 that operates as a ground plane. One corner of the metal cover 105 is the first corner ground element 108 and another corner of the metal cover 105 is a second corner ground element 110 disposed at a periphery of the metal cover 105. The middle strip element 106, also referred to herein as an elongated portion, is physically separated from the first corner ground element 108 by a first cutout 118 in the metal cover 105 and the middle strip element 106 is physically separated from the second corner ground element 110 by a second cutout 120 in the metal cover 105. The middle strip element 106 is also disposed at the periphery of the metal cover 105. In one embodiment, the first cutout 118 and second cutout 120 measure 1.8 mm in width. In another embodiment, the first cutout 118 and second cutout 120 measure 2.0 mm in width. Alternatively, other widths may be used. The middle strip element 106 can operate as part of the metal cover 105 in a structural manner. The middle strip element 106 can also be operational in an antenna mode of the user device 100, as well as in a proximity sensing mode of the user device 100. In particular, the middle strip element 106 can operate as an electrode of a proximity sensing circuit. A capacitance of the electrode can be measured by a proximity sensing circuit 150. The proximity sensing circuit 150 can be coupled to the RF feed 102. A switch can control the coupling of the RF circuit 140 and the proximity sensing circuit 150 to the RF feed. Alternatively, matching components can be used to permit both the proximity sensing circuit 150 and the RF circuit 140 to be coupled to the RF feed. It should be noted that the first corner ground element 108 and the second corner ground element 110 can be separate parts or can be integrated with the rest of the metal cover 105.

The low-band feeding structure 101 is made up of the ground plane of the metal cover 105, the feeding element 104, the middle strip element 106 and the first corner ground element 108. The low-band feeding structure 101 with the capacitor 116 operates a first radiator with dual resonance. The high-band parasitic structure 103 is made up of the ground plane of the metal cover 105, a grounding line 122 and the second corner ground element 110.

In the depicted embodiment, the feeding element 104 includes a first section that extends from a feeding point 112 at the RF feed 102 along a first path, a second section that extends from a distal end of the first section along a second path, and a third section that extends from a distal end of the second section along a third path and couples to a first end of the middle strip element 106. In the depicted embodiment, the first path is a first direction, the second path is a second direction that is perpendicular to the first direction, and the third path is the first direction. Alternatively, the first, second and third paths may not be perpendicular and may not be linear. The middle strip element 106 extends from the first end along a fourth path (e.g., second direction in the depicted embodiment) to a second end of the middle strip element. The first corner ground element 108 includes a first section that extends from the ground plane along a fifth path that follows a direction of the first path to form a first gap (illustrated in FIG. 2A) between the feeding element 104 and the first corner ground element 108. In the depicted embodiment, the first section extends from the ground plane in the second direction to the second end of the middle strip element. A second section of the first corner ground element 108 extends from a distal end of the first section of the first corner ground element 108 along a sixth path that follows a direction of the second path to form a second gap (illustrated in FIG. 2A) between the feeding element 104 and the first corner ground element 108. In the depicted embodiment, the second section extends from the distal end of the first section in the second direction to form the second gap.

In one embodiment, as illustrated in FIG. 1A, the capacitor 116 is disposed between the feeding element 104 and the first corner ground element 108 at the distal end of the feeding element 104, near an end of the first corner ground element 108.

In the depicted embodiment, the second corner ground element 110 is coupled to the ground plane at a grounding point 114 via the grounding line 122. The grounding line 122 may include a first section that extends out from the grounding point in a first path, a second section that extends form a distal end of the first section in a second path, and a third section that extends from a distal end of the second section in a third path to couple to the second corner ground element 110.

In one embodiment, the RF circuit 140 includes a wireless area network (WAN) module. The WAN module is operable to cause the feeding element 104, the middle strip element 106 and the first corner ground element 108 to radiate electromagnetic energy in a first frequency range in a first resonant mode and a second resonant mode. In another embodiment, the RF circuit 140 may include other modules, such as a wireless local area network (WLAN) module, a personal area network (PAN) module, global navigation satellite system (GNSS) module (e.g., global positioning system (GPS) module), or the like. The low-band feeding structure 101 can be designed to be self-resonant at 800 MHz and 950 MHz for the dual resonance. These modes can be further matched to desired working bands of interest. Alternatively, other resonant modes can be achieved, such as for WLAN frequency bands. For example, in dual-band Wi-Fi® networks, the low-band feeding structure 101 and high-band parasitic structure 102 can be matched in the two modes to cover the 2.4 GHz band and the 5 GHz band. For example, the WLAN module may include a WLAN RF transceiver for communications on one or more Wi-Fi® bands (e.g., 2.4 GHz and 5 GHz). It should be noted that the Wi-Fi® technology is the industry name for wireless local area network communication technology related to the IEEE 802.11 family of wireless networking standards by Wi-Fi Alliance. For example, a dual-band WLAN RF transceiver allows an electronic device to exchange data or connection to the Internet wireless using radio waves in two WLAN bands (2.4 GHz band, 5 GHz band) via one or multiple antennas. For example, a dual-band WLAN RF transceiver includes a 5 GHz WLAN channel and a 2.4 GHz WLAN channel. In other embodiments, the antenna architecture may include additional RF modules and/or other communication modules, such as a wireless local area network (WLAN) module, a GPS receiver, a near field communication (NFC) module, an amplitude modulation (AM) radio receiver, a frequency modulation (FM) radio receiver, a personal area network (PAN) module (e.g., Bluetooth® module, Zigbee® module), a Global Navigation Satellite System (GNSS) receiver, or the like. The RF circuit 140 may include one or multiple RFFE (also referred to as RF circuitry). The RFFEs may include receivers and/or transceivers, filters, amplifiers, mixers, switches, and/or other electrical components. The RF circuit 140 may be coupled to a modem that allows the user device 100 to handle both voice and non-voice communications (such as communications for text messages, multimedia messages, media downloads, web browsing, etc.) with a wireless communication system. The modem may provide network connectivity using any type of digital mobile network technology including, for example, LTE, LTE advanced (4G), CDPD, GPRS, EDGE, UMTS, 1×RTT, EVDO, HSDPA, WLAN (e.g., Wi-Fi® network), etc. In the depicted embodiment, the modem can use the RF circuit 140 to radiate electromagnetic energy on the antennas to communication data to and from the user device 100 in the respective frequency ranges. In other embodiments, the modem may communicate according to different communication types (e.g., WCDMA, GSM, LTE, CDMA, WiMAX, etc.) in different cellular networks.

Additional details regarding the current follow for the dual resonance are described below with respect to FIG. 3B. In short, the capacitor 116 increases the radiation by changing the current flow on the first corner ground element to be the same direction as the current flow along the feeding element 104. This cause the low-band feeding structure 101 to have dual resonance. The capacitor 116 may be a discrete component with a capacitive value or may be conductive traces with the corresponding capacitance value. In one embodiment, the capacitor 116 has a capacitance value of 2 pF. This type of capacitance value gives a very small loading effect when in the proximity sensing mode, but provides the looping current effect in the antenna mode as described herein. The feeding element 104, the middle strip element 106, and the first corner ground element 108 (collectively the low-band feeding structure 101) are operable to cause the second corner ground element 110 to radiate electromagnetic energy in a second frequency range in a third resonant mode. It should be noted that radiation enables functionality of both transmission and receiving data using reciprocity. That is there is a high-band coupling between the middle strip element 106 and the second corner ground element 110 via the second cutout 120. In one embodiment, the first frequency range is between approximately 770 MHz and approximately 1.0 GHz and the second frequency range is between approximately 1.7 GHz and 2.2 GHz. It should be noted that if the device scales up, the $S_{11}$ parameter 602 could be extended to lower frequencies, e.g., 700 MHz.

The user device 100 (also referred to herein as an electronic device) may be any content rendering device that includes a modem for connecting the user device to a network. Examples of such electronic devices include electronic book readers, portable digital assistants, mobile phones, laptop computers, portable media players, tablet computers, cameras, video cameras, netbooks, notebooks, desktop computers, gaming consoles, Blu-ray® or DVD players, media centers, drones, speech-based personal data assistants, and the like. The user device may connect to a network to obtain content from a server computing system (e.g., an item providing system) or to perform other activities. The user device may connect to one or more different types of cellular networks.

In one embodiment, the user device 100 includes a single radio frequency (RF) feed, RF circuitry coupled to the single RF feed, and a metal cover. The metal cover includes a middle strip element, a first corner ground element, and a second corner ground element. The middle strip element is physically separated from the first corner ground element by a first cutout in the metal cover and the middle strip element is physically separated from the second corner ground element by a second cutout in the metal cover. The antenna structure is coupled to the RF feed and includes a ground plane (e.g., chassis of the user device 100 or metal back cover), a first antenna formed by a feeding element, the middle strip element and the first corner ground element and a second parasitic antenna formed by the second corner ground element.

In one embodiment, the feeding element includes a first section, a second section, and a third section. The first section extends from a feeding point at the RF feed along a first path. The second section extends from a distal end of the first section along a second path. The third section extends from a distal end of the second section along a third path and couples to a first end of the middle strip element. The middle strip element extends from the first end along a fourth path to a second end.

In a further embodiment, the first corner ground element includes a first section and a second section. The first section extends from the ground plane along a fifth path that follows a direction of the first path to form a first gap between the feeding element and the first corner ground element. The second section extends from a distal end of the first section of the first corner ground element along a sixth path that follows a direction of the second path to form a second gap between the feeding element and the first corner ground element.

In a further embodiment, a capacitor disposed between the feeding element and the first corner ground element at the distal end of the feeding element. The second corner ground element is coupled to the ground plane at a grounding point via a grounding line.

In a further embodiment, the RF circuitry comprises a WAN module that is operable to cause the feeding element, the middle strip element and the first corner ground element to radiate electromagnetic energy in a first frequency range in a first resonant mode and a second resonant mode. The feeding element, the middle strip element and the first corner ground element are operable to cause the second corner ground element to radiate electromagnetic energy in a second frequency range in a third resonant mode. In one embodiment, the first frequency range is between approximately 770 MHz and approximately 1.0 GHz, and wherein the second frequency range is between approximately 1.7 GHz and 2.2 GHz. Alternatively, other frequency ranges may be achieved.

In another embodiment, an electronic device includes a metal cover with a first corner part, a second corner part, and an elongated part disposed between the first corner part and the second corner part. The elongated part is physically separated from the first corner part by a first cutout in the metal cover and the elongated part is physically separated from the second corner part by a second cutout in the metal cover. A RF circuit is coupled to a RF feed and the RF feed is coupled to a feeding element at a feeding point. The feeding element is coupled to the elongated part at a distal end, the distal end being farthest from the feeding point. A capacitor is coupled between the feeding element and the first corner part near the distal end of the feeding element. The RF circuit is operable to cause the feeding element, the elongated part, and the first corner part to radiate electromagnetic energy as a first radiator in a first frequency range with dual resonance.

In a further embodiment, the first radiator is operable to cause the second corner part to radiate electromagnetic energy as a parasitic ground element in a second frequency range, the second frequency range being higher than the first frequency range.

In a further embodiment, the RF circuit is operable to apply a signal at the feeding point. The signal causes a first current flow along the feeding element towards the elongated part and causes a second current flow along the first corner part towards the first cutout in the same direction as the first current flow.

In one embodiment, the first cutout and the second cutout are disposed at symmetric locations on a first side of the electronic device relative to a center point on the first side of the electronic device.

In another embodiment, the electronic device includes a switch coupled between the RF circuit and the RF feed, the first switch switching the electronic device between an antenna mode and a proximity sensing mode. The electronic device further includes a proximity sensing circuit coupled to the switch. The proximity sensing circuitry is operable to measure a capacitance of the elongated part in the proximity sensing mode. It should be noted that the elongated part is operable to radiate the electromagnetic energy as part of the first radiator in the antenna mode. In another embodiment, the electronic device does not switch between modes, but uses an inductor as an RF choke between the RF feed and the proximity sensing circuitry as described herein.

In a further embodiment, the feeding element includes a first section, a second section, and a third section. The first section extends from the feeding point along a first path. The second section that extends from a distal end of the first section along a second path. The third section extends from a distal end of the second section along a third path and couples to the middle strip element at a first end. The middle strip element extends along a fourth path to a second end. The first corner part includes a first section and a second section. The first section extends along a fifth path that follows a direction of the first path to form a first gap between the feeding element and the first corner part. The second section extends from a distal end of the first section of the first corner part along a sixth path that follows a direction of the second path to form a second gap between the feeding element and the first corner part.

In a further embodiment, the antenna structure includes a grounding line coupled to the second corner part and coupled to a ground plane at a grounding point. In another embodiment, the first corner part is an L-shape that starts at a first side of the metal cover and bends to a second side of the electronic device (e.g., bends around a first corner of the electronic device to the second side). The first side and the second side of the metal cover may be curved or rounded on one or more edges.

In another embodiment, the antenna structure includes a grounding line coupled between a distal end of the second corner part and a grounding point at the ground plane. The second corner part is a second L-shape that starts at a third side of the metal cover and bends to the second side (e.g., bends around a second corner of the user device to the second side. The third side of the metal cover may be curved or otherwise rounded as described herein.

In one embodiment, the RF circuit includes a WAN module to cause the feeding element, the elongated part and the first corner part to radiate electromagnetic energy in the first frequency range in two resonant modes. The feeding element, the elongated part and the first corner part are operable to cause the second corner part to radiate electromagnetic energy in the second frequency range in a third resonant mode. In one embodiment, the first frequency range is between approximately 770 MHz and approximately 1.0 GHz, and the second frequency range is between approximately 1.7 GHz and 2.2 GHz. Alternatively, other frequencies may be achieved with similar antenna structures.

During operation of the user device 100, RF circuit applies a signal to cause a first radiator to radiate electromagnetic energy in a first frequency range in an antenna mode. As described herein, the first radiator may be similar to the low-band feeding element 101, including a feeding element, a first corner part of the metal cover, an elongated part of the metal cover, and a capacitor. The feeding element is coupled to the elongated part. The elongated part is coupled to a distal end of the feeding element, and the first corner part is physically separated from the elongated part by a first cutout in the metal cover. The capacitor is disposed between the first corner part and the feeding element at a distal end of the feeding element. The signal causes a first current to flow along the feeding element towards the elongated part. The capacitor causes a second current to flow from a ground plane, around the first corner part and towards the first cutout, the first current and the second current causing a dual resonance by the first radiator. In addition, the feeding element parasitically induces a third current on a second radiator to radiate electromagnetic energy in a second frequency range in the antenna mode. As described herein, the second radiator may be similar to the high-band parasitic element 103. The second radiator may include a second corner part of the metal cover with a grounding line coupled between a grounding point at the ground plane and a distal end of the second corner part.

In a further embodiment, the user device switches from the antenna mode to a proximity sensing mode and a proximity sensing circuit measures a capacitance of the elongated part to detect an object proximate to the elongated part in a proximity sensing mode.

In a further embodiment, the signal is applied by a WAN module to cause the feeding element, the elongated part and the first corner part to radiate electromagnetic energy in the first frequency range in two resonant modes. The feeding element, the elongated part and the first corner part are operable to cause the second corner part to radiate electromagnetic energy in the second frequency range in a third resonant mode. In one embodiment, the first frequency range is between approximately 770 MHz and approximately 1.0 GHz, and the second frequency range is between approximately 1.7 GHz and 2.2 GHz.

Figure 1B:
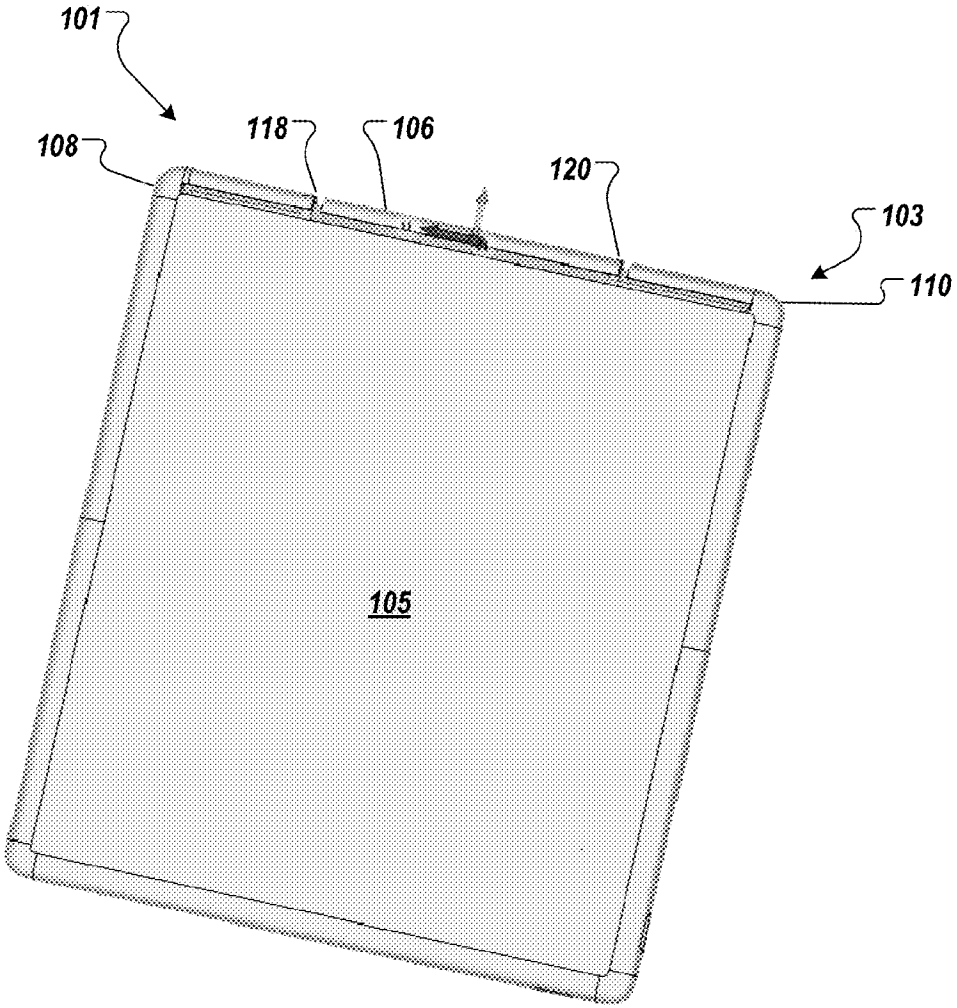
FIG. 1B is a diagram of a metal cover of the user device with the low-band feeding structure and the high-band parasitic structure according to one embodiment.

It should be noted that the diagram of FIG. 1B does not illustrate the entire metal cover 105 to show the low-band feeding structure 101 and the high-band parasitic structure 103. FIG. 1B shows the metal cover 105 cover the entire back of the user device 100.

FIG. 1B is a diagram of a metal cover 105 of the user device 100 with the low-band feeding structure 101 and the high-band parasitic structure 103 according to one embodiment. In particular, the middle strip element 106 is shown as being separated from the first corner ground element 108 by the first cutout 118 in the metal cover 105 and the middle strip element 106 is physically separated from the second corner ground element 110 by the second cutout 120 in the metal cover 105.

Figure 2A:
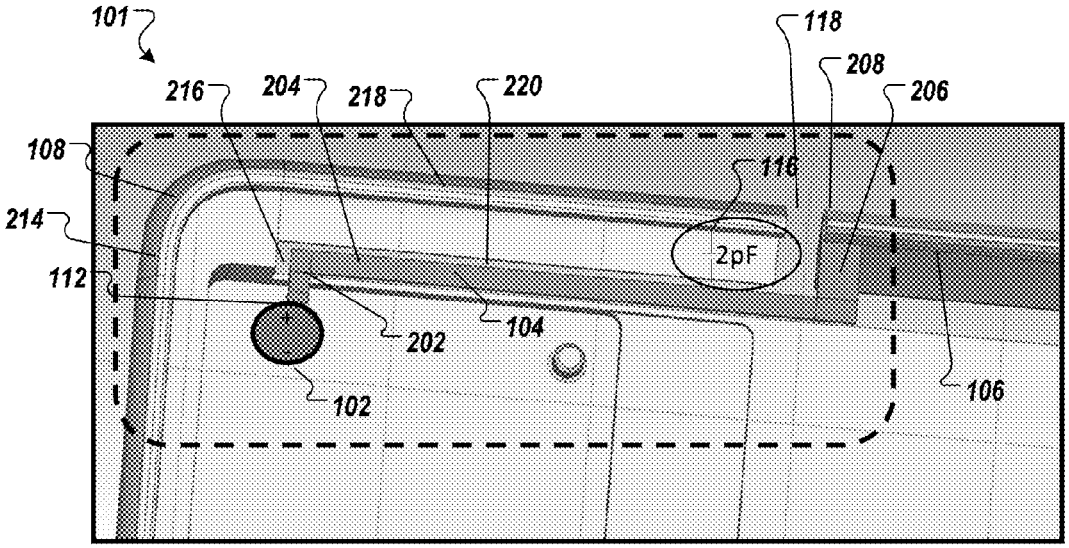
FIG. 2A shows an expanded view of the low-band feeding structure according to one embodiment.

FIG. 2A shows an expanded view of the low-band feeding structure 101 according to one embodiment. As described above, the feeding element 104 includes a first section 202 that extends from the feeding point 112 at the RF feed 102 along a first path, a second section 204 that extends from a distal end of the first section 202 along a second path, and a third section 206 that extends from a distal end of the second section 204 along a third path and couples to a first end 208 of the middle strip element 106. The middle strip element 106 extends from the first end 208 along a fourth path to a second end 210 illustrated in FIG. 2B. The first corner ground element 108 includes a first section 214 that extends from the ground plane along a fifth path that follows a direction of the first path to form a first gap 216 between the feeding element 104 (first section 202) and the first corner ground element 108 (first section 214). A second section 218 of the first corner ground element 108 extends from a distal end of the first section 214 of the first corner ground element 108 along a sixth path that follows a direction of the second path to form a second gap 220 between the feeding element 104 (second section 204) and the first corner ground element 108 (second section 218).

In the depicted embodiment, the first corner ground element 108 connects in an L-shape above the chassis of the metal cover 105 as depicted. Also, in the depicted embodiment, the sides of the metal cover are curved or otherwise rounded. In other embodiments, the sides may have different shapes.

In the depicted embodiment, the capacitor 116 is disposed between the second section 204 of the feeding element 104 and the second section 218 of the first corner ground element 108 at the distal end of the feeding element 104, near an end of the first corner ground element 108 that is closest to the first cutout 118.

Figure 2B:
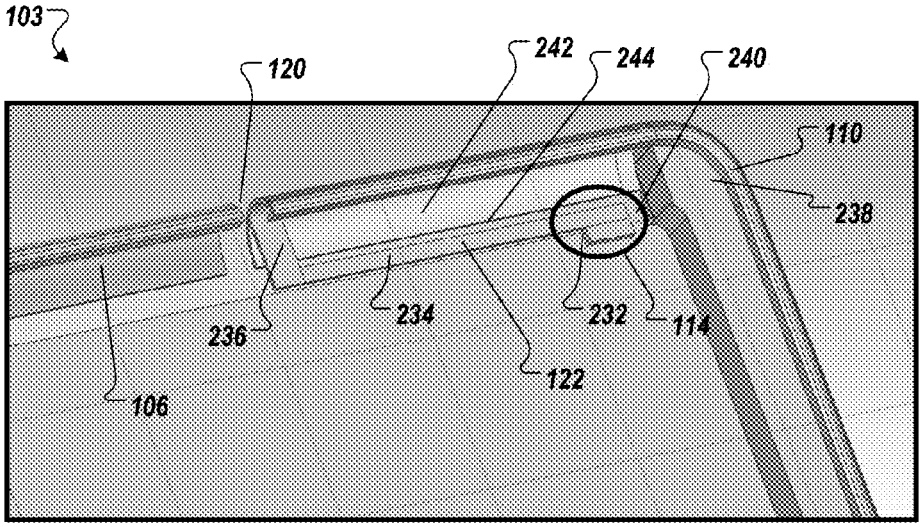
FIG. 2B shows an expanded view of the high-band parasitic structure according to one embodiment.

FIG. 2B shows an expanded view of the high-band parasitic structure 103 according to one embodiment. The high-band parasitic structure 103 is coupled to the ground plane at the grounding point 114 via the grounding line 122. The grounding line 122 may include a first section 232 that extends out from the grounding point in a first path, a second section 234 that extends form a distal end of the first section 232 in a second path, and a third section 236 that extends from a distal end of the second section 234 in a third path to couple to the second corner ground element 110. The second corner ground element 110 includes a first section 238 that extends from the ground plane along a fourth path that follows a direction of the first path to form a first gap 240 between the grounding line 122 (first section 232) and the second corner ground element 110 (first section 238). A second section 242 of the second corner ground element 110 extends from a distal end of the first section 238 of the second corner ground element 110 along a fifth path that follows a direction of the second path to form a second gap 244 between the grounding line 122 (second section 234) and the second corner ground element 110 (second section 242). In one embodiment, the high-band parasitic structure 103 operates as a parasitic loop antenna. This parasitic loop antenna may enhance reliability of the antenna structure.

In the depicted embodiment, the second corner ground element 110 connects in an L-shape above the chassis of the metal cover 105 as depicted. Also, in the depicted embodiment, the sides of the metal cover are curved or otherwise rounded. In other embodiments, the sides may have different shapes.

Figure 3A:
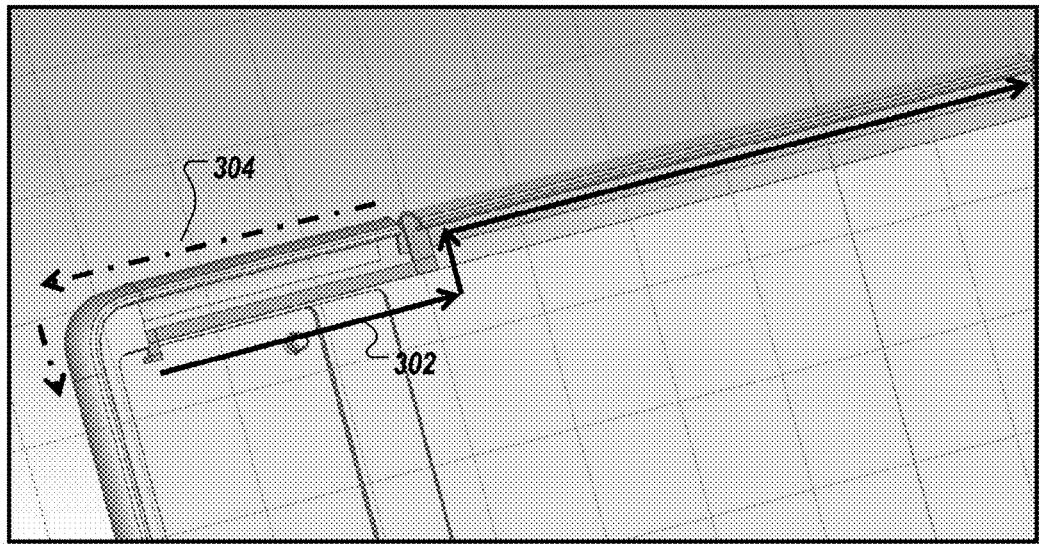
FIG. 3A illustrates current flows of the low-band feeding structure according to one embodiment.

FIG. 3A illustrates current flows of the low-band feeding structure 101 according to one embodiment. In FIG. 3A, a first current 302 flows from the RF feed 102 along the feeding element 104 and through the middle strip element 106. A second current 304 flows from a distal end of the first corner ground element 108 towards the ground plane. This may cause the radiation to be reduced in that the first current 302 and second current 304 tend to cancel out due to the currents flowing in different directions relative to the RF feed 102.

Figure 3B:
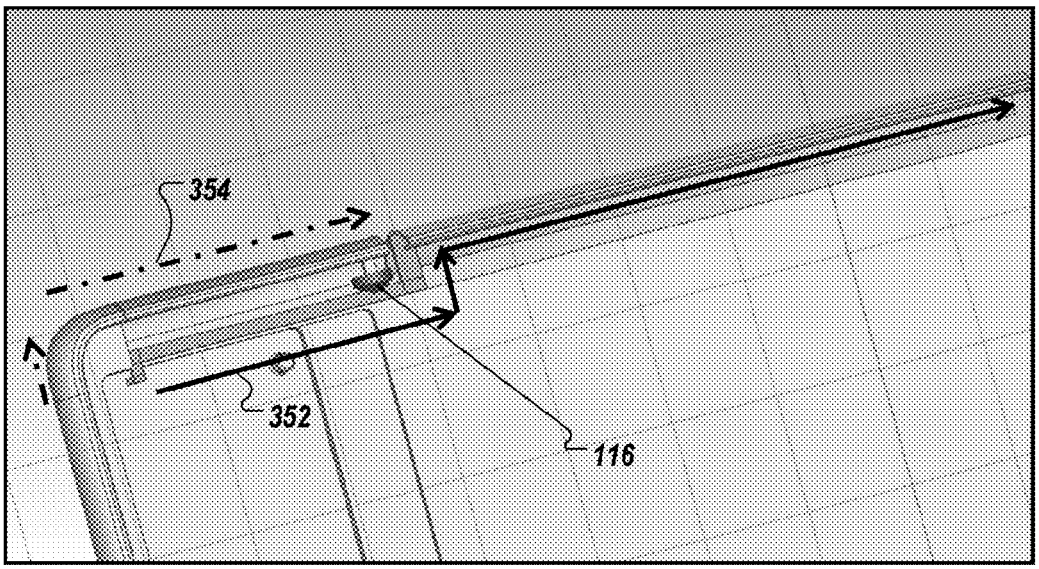
FIG. 3B illustrates current flows of the low-band feeding structure according to one embodiment.

FIG. 3B illustrates current flows of the low-band feeding structure 101 according to one embodiment. In FIG. 3B, a first current 352 flows from the RF feed 102 along the feeding element 104 and through the middle strip element 106. A second current 354 flows from a proximal end of the first corner ground element 108 towards the distal end of the first corner ground element 108. This may cause the radiation to be enhanced as current flows in the same direction. The capacitor 116 can be used to match the RF circuit 140 and block direct current to keep the proximity sensor signal quality high. For example, the capacitor 116 may be 2 pF in value to match the RF circuit 140. The current flowing in the same direction causes the low-band feeding structure 101 to operate as a loop feeding element. The low-band feeding structure 101 parasitically induces another current on the high-band parasitic structure 103 (not illustrated in FIG. 3B).

Figure 4A:
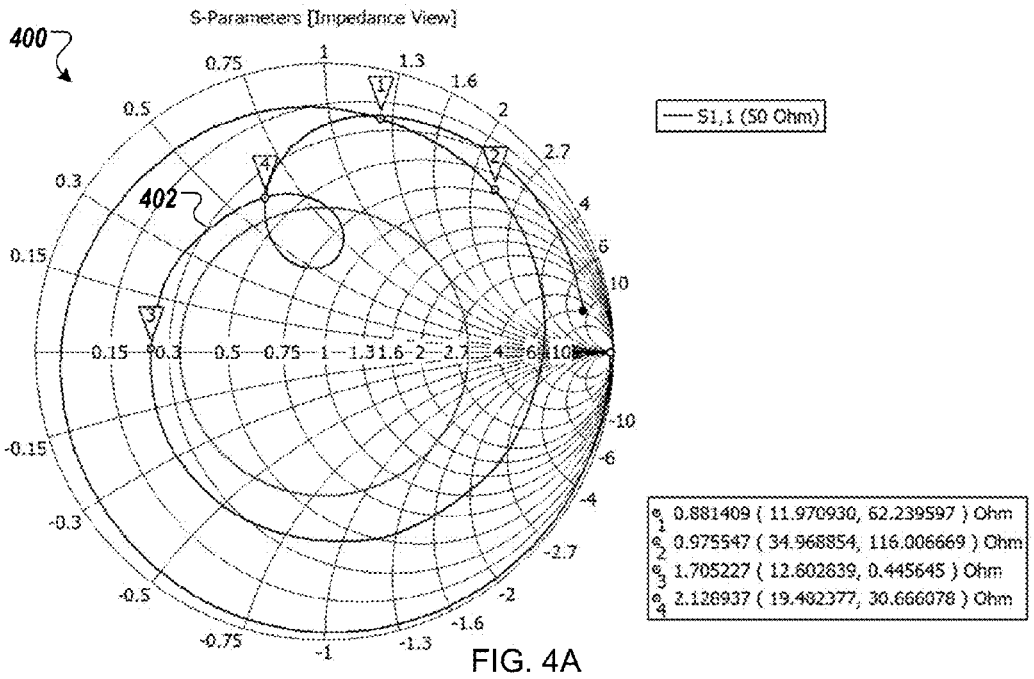
FIG. 4A is a Smith chart of an input impedance of the low-band feeding structure according to one embodiment.

FIG. 4A is a Smith chart 400 of an input impedance of the low-band feeding structure 101 according to one embodiment. The Smith chart 400 illustrates how the impedance and reactance behave at one or more frequencies for the low-band feeding structure 101. In particular, the line 402 corresponds to the impedance of the low-band feeding structure 101 without the capacitor 116 of FIG. 1A. The Smith chart 400 illustrates the low-band feeding structure 101 as having two resonant modes, one in the low band and one in the high band, as the locus of antenna input impedance on the Smith chart as identified as the two loops. As illustrated in Smith chart 400, the low-band feeding structure 101 generates a single low-band resonance and the low-band feeding structure 101 is not well matched for the high-band parasitic structure 103.

Figure 4B:
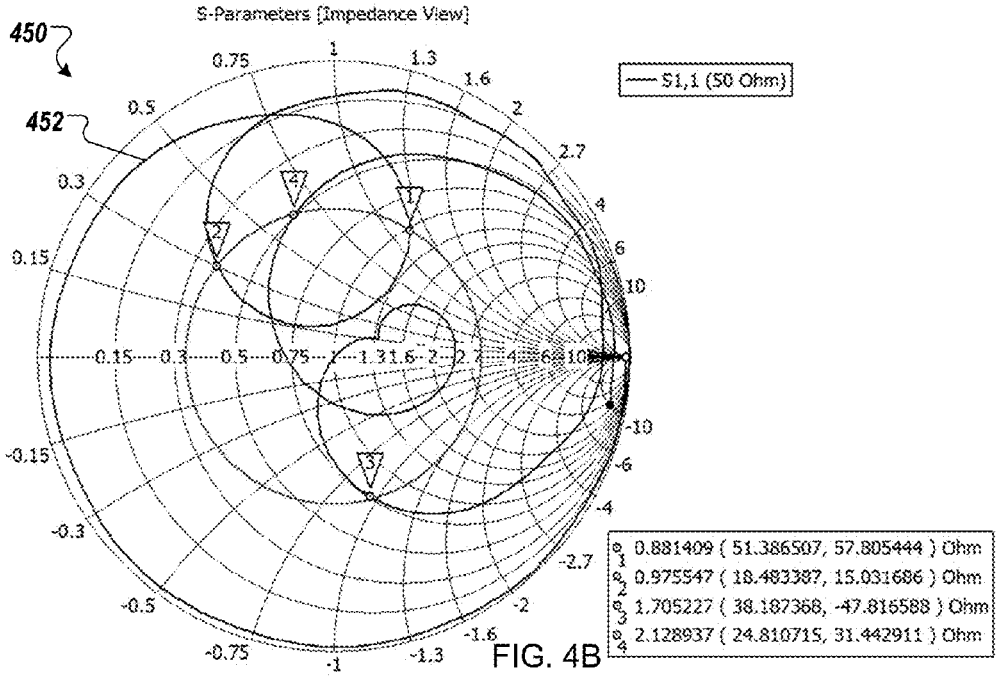
FIG. 4B is a Smith chart of an input impedance of the low-band feeding structure according to one embodiment.

FIG. 4B is a Smith chart 450 of an input impedance of the low-band feeding structure 101 according to one embodiment. The Smith chart 450 illustrates how the impedance and reactance behave at one or more frequencies for the low-band feeding structure 101. In particular, the line 402 corresponds to the impedance of the low-band feeding structure 101 with the capacitor 116 of FIG. 1A. The Smith chart 450 illustrates the low-band feeding structure 101 as having three resonant modes, two in the low band and one in the high band, as the locus of antenna input impedance on the Smith chart as identified as the three loops. As illustrated in Smith chart 450, the low-band feeding structure 101 with the capacitor 116 generates double resonance and the low-band feeding structure is better matched for the high-band parasitic structure 103.

As noted above, the low-band feeding structure 101 with the capacitor 116 can achieve dual resonance without impedance matching circuits. In other embodiments, an impedance matching circuit can be used. The impedance matching circuit can be used to further enlarge the bandwidth in the low band.

Figure 5:
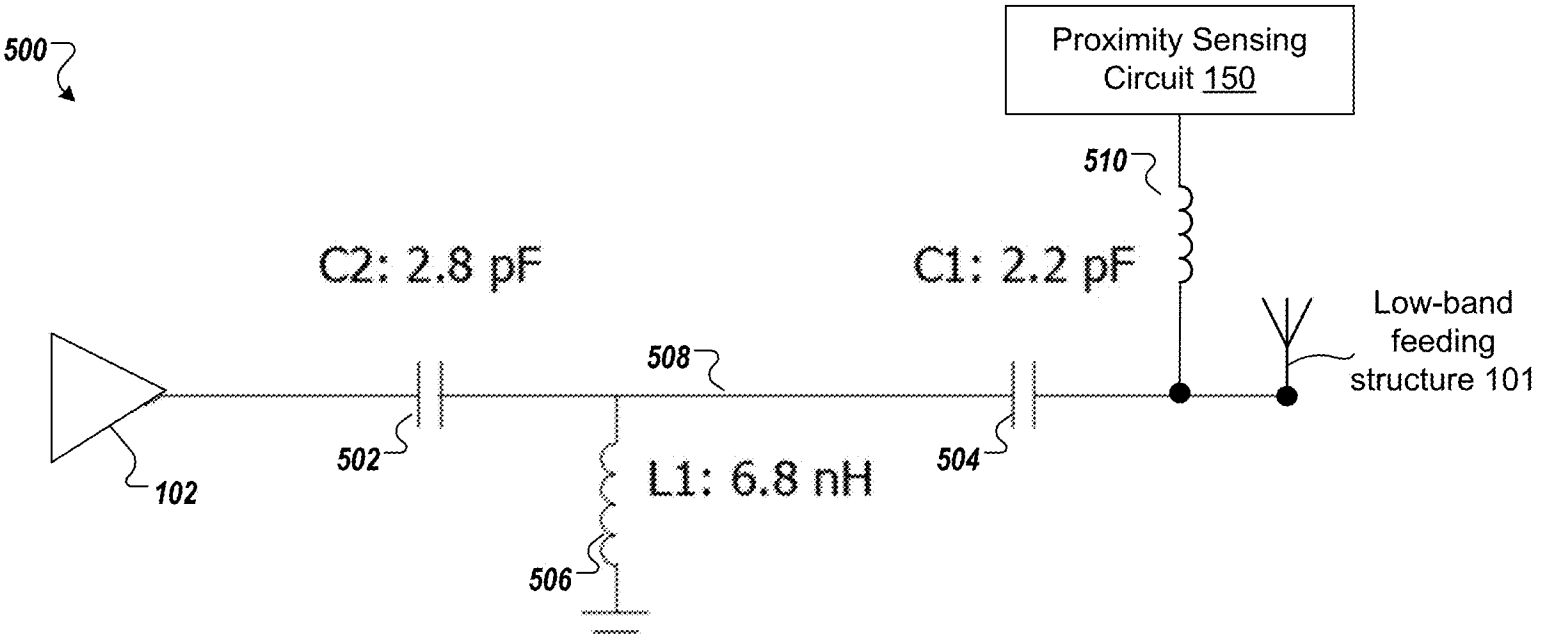
FIG. 5 is a schematic diagram of an impedance matching circuit according to one embodiment.

FIG. 5 is a schematic diagram of an impedance matching circuit 500 according to one embodiment. In this embodiment, the impedance matching circuit 500 is disposed in-line with the RF feed 102 and the low-band feeding structure 101. The impedance matching circuit 500 can also be disposed before the RF feed 102 on the circuit board where the RF circuit resides. In this embodiment, the impedance matching circuit 500 includes two series capacitors 502, 504 and a shunt inductor 506. The first series capacitor 502 is coupled to the RF feed 102 and an intermediate node 508. The second series capacitor 504 is coupled between the intermediate node 508 and the low-band feeding structure 101. The shunt inductor 506 is coupled between the intermediate node 508 and a ground potential. In another embodiment, the output of the impedance matching circuit 500 is coupled to the RF feed 142. The input of the impedance matching circuit 500 may be coupled to an output of the modem or other antenna circuitry. In one embodiment, the impedance matching circuit 500 is disposed on a PCB. In the depicted embodiment, the impedance matching circuit 500 is a simple matching T circuit and can be used to further enlarge the bandwidth. Alternatively, other components and other configurations of components may be used for matching the low-band feeding structure 101 in other ways.

In some embodiments, a proximity sensing circuit 150 is coupled to the low-band feeding structure 101 via an inductor 510. Alternatively, the proximity sensing circuit 150 can be coupled to the low-band feeding structure 101 without an inductor. The inductor 510 may operate to filter signals from the RF circuitry driven at RF feed 102. Alternatively, other configurations of the RF circuitry and proximity sensing circuitry may be utilized for the two modes of the low-band feeding structure 101. In one embodiment, the low-band feeding structure 101 can be switched between an antenna mode and a proximity sensing mode. In another embodiment, the low-band feeding structure 101 can operate concurrently in the antenna mode and the proximity sensing mode because the proximity sensing mode operates at a much lower frequency than the antenna mode.

Figure 6A:
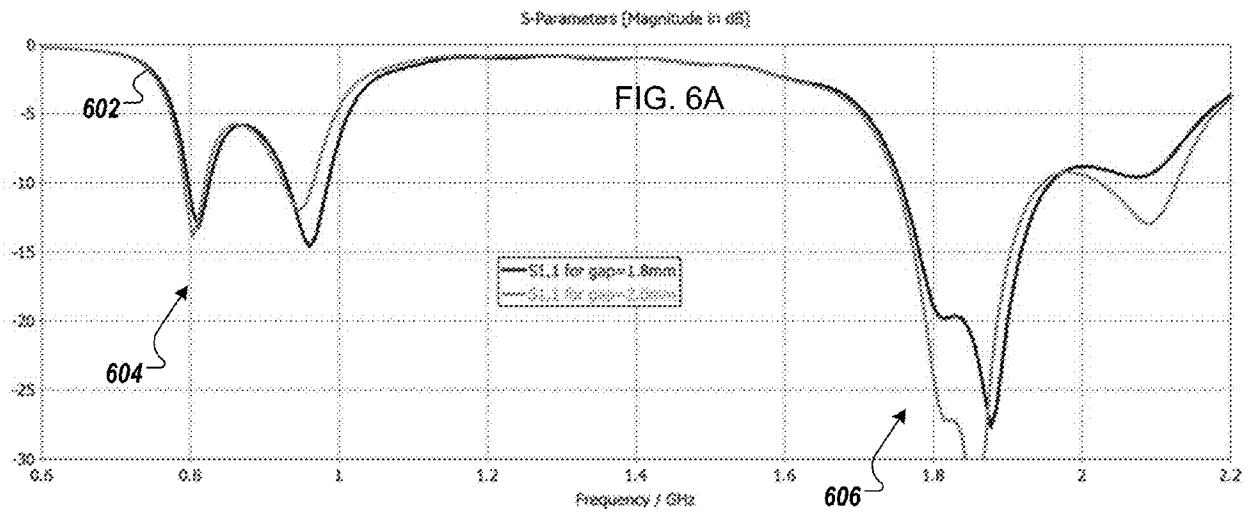
FIG. 6A is a graph of $S_{11}$ parameter of the antenna structure of FIG. 1A according to one embodiment.

FIG. 6A is a graph 600 of the $S_{11}$ parameter 602 of the antenna structure of FIG. 1A according to one embodiment. The graph 600 shows the $S_{11}$ parameter 602 of the antenna structure in a low band (LB) 604 and in a high band (HB) 606. The $S_{11}$ parameter 602 is measured in dB. In one embodiment, the LB 604 covers a frequency range between approximately 770 MHz and approximately 1.0 GHz, such as for GSM850/900 bands. Alternatively, other frequencies in the LB 604 may be covered by the low-band feeding element 101. In one embodiment, the HB 606 covers a frequency range between approximately 1.7 GHz and 2.2 GHz. Alternatively, other frequencies in the HB 606 may be covered by the high-band parasitic element 103.

Figure 6B:
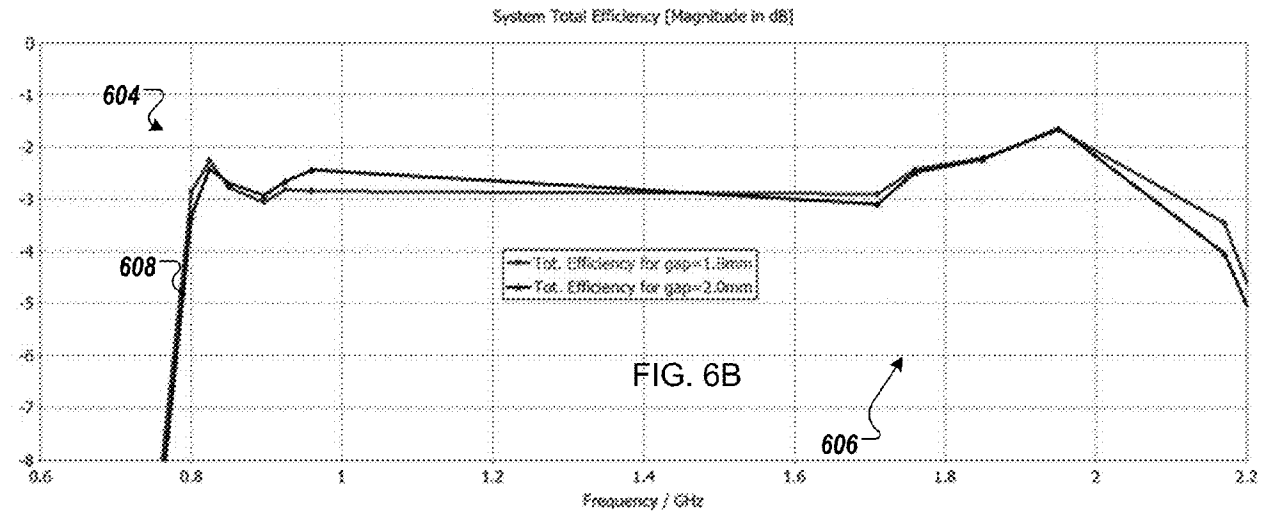
FIG. 6B is a graph of efficiencies of the antenna structure of FIG. 1A according to one embodiment.

FIG. 6B is a graph 650 of efficiencies of the antenna structure of FIG. 1A according to one embodiment. The total efficiency of the antenna structure can be measured by including the loss of the structure and mismatch loss. The graph 650 shows the measured efficiencies 652 of the antenna structure in the LB 604 and the HB 606. In the depicted embodiment, the measured efficiencies 652 are good between approximately 770 MHz and approximately 1.0 GHz in the LB 604 and between 1.71 GHz and 2.2. GHZ in the HB 606.

Figure 7:
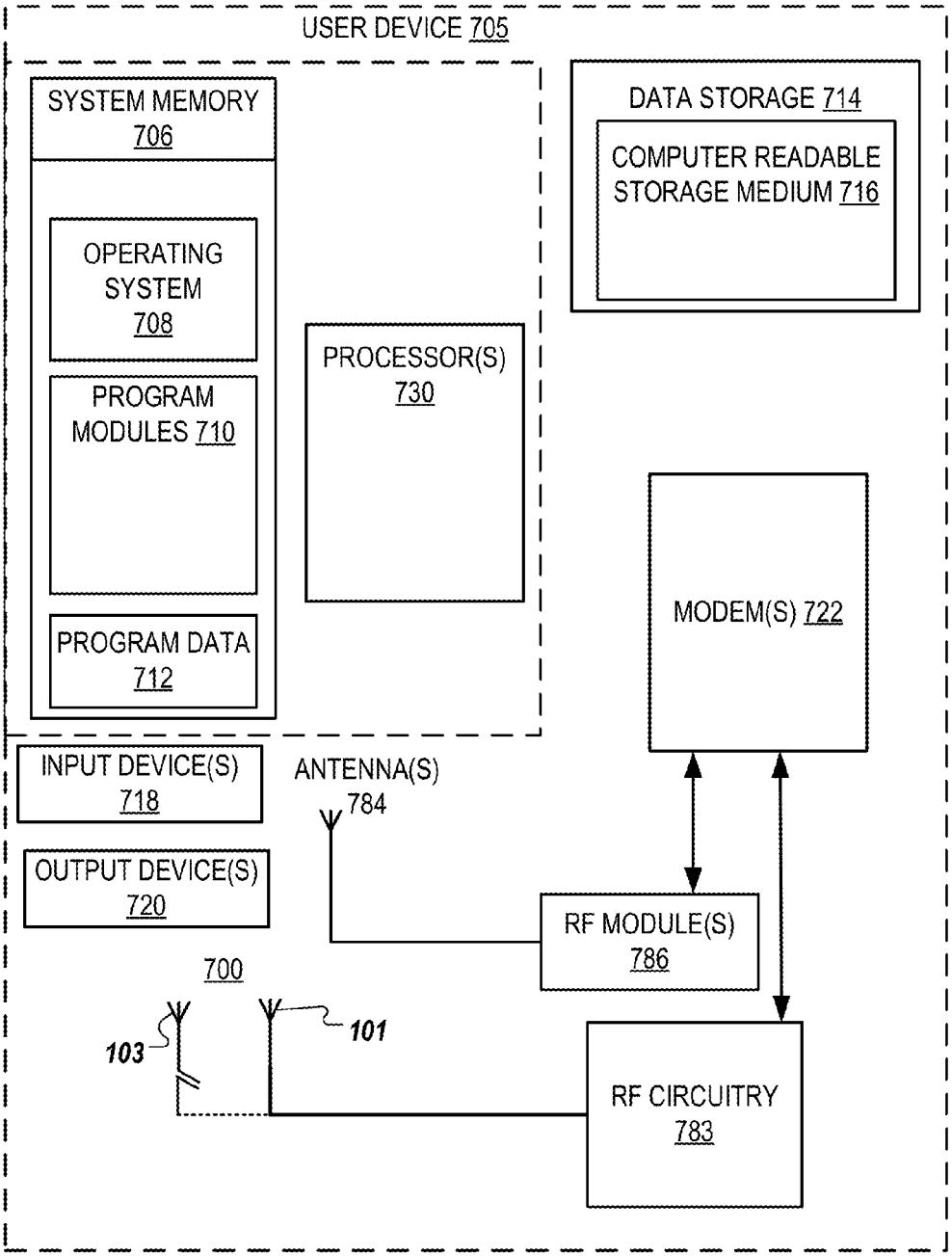
FIG. 7 is a block diagram of a user device in which embodiments of an antenna structure with a low-band feeding element and a high-band parasitic element may be implemented.

FIG. 7 is a block diagram of a user device 705 in which embodiments of an antenna structure 700 with a low-band feeding element 101 and a high-band parasitic element 103 may be implemented. The user device 705 may correspond to the user device 100 of FIG. 1A. The user device 705 may be any type of computing device such as an electronic book reader, a PDA, a mobile phone, a laptop computer, a portable media player, a tablet computer, a camera, a video camera, a netbook, a desktop computer, a gaming console, a DVD player, a Bluray®, a computing pad, a media center, a voice-based personal data assistant, and the like. The user device 705 may be any portable or stationary user device. For example, the user device 705 may be an intelligent voice control and speaker system. Alternatively, the user device 705 can be any other device used in a WLAN network (e.g., Wi-Fi® network), a WAN network, or the like.

The user device 705 includes one or more processor(s) 730, such as one or more CPUs, microcontrollers, field programmable gate arrays, or other types of processors. The user device 705 also includes system memory 706, which may correspond to any combination of volatile and/or non-volatile storage mechanisms. The system memory 706 stores information that provides operating system component 708, various program modules 710, program data 712, and/or other components. In one embodiment, the system memory 706 stores instructions of the methods as described herein. The user device 705 performs functions by using the processor(s) 730 to execute instructions provided by the system memory 706.

The user device 705 also includes a data storage device 714 that may be composed of one or more types of removable storage and/or one or more types of non-removable storage. The data storage device 714 includes a computer-readable storage medium 716 on which is stored one or more sets of instructions embodying any of the methodologies or functions described herein. Instructions for the program modules 710 may reside, completely or at least partially, within the computer-readable storage medium 716, system memory 706 and/or within the processor(s) 730 during execution thereof by the user device 705, the system memory 706 and the processor(s) 730 also constituting computer-readable media. The user device 705 may also include one or more input devices 718 (keyboard, mouse device, specialized selection keys, etc.) and one or more output devices 720 (displays, printers, audio output mechanisms, etc.).

The user device 705 further includes a modem 722 to allow the user device 705 to communicate via a wireless network (e.g., such as provided by the wireless communication system) with other computing devices, such as remote computers, an item providing system, and so forth. The modem 722 can be connected to RF circuitry 783 and zero or more RF modules 786. The RF circuitry 783 may be a WLAN module, a WAN module, PAN module, or the like. Antennas 788 are coupled to the RF circuitry 783, which is coupled to the modem 722. Zero or more antennas 784 can be coupled to one or more RF modules 786, which are also connected to the modem 722. The zero or more antennas 784 may be GPS antennas, NFC antennas, other WAN antennas, WLAN or PAN antennas, or the like. The modem 722 allows the user device 705 to handle both voice and non-voice communications (such as communications for text messages, multimedia messages, media downloads, web browsing, etc.) with a wireless communication system. The modem 722 may provide network connectivity using any type of mobile network technology including, for example, cellular digital packet data (CDPD), general packet radio service (GPRS), EDGE, universal mobile telecommunications system (UMTS), 1 times radio transmission technology (1×RTT), evaluation data optimized (EVDO), high-speed down-link packet access (HSDPA), Wi-Fi®, Long Term Evolution (LTE) and LTE Advanced (sometimes generally referred to as 4G), etc.

The modem 722 may generate signals and send these signals to antenna 788, and 784 via RF circuitry 783, and RF module(s) 786 as descried herein. User device 705 may additionally include a WLAN module, a GPS receiver, a PAN transceiver and/or other RF modules. These RF modules may additionally or alternatively be connected to one or more of antennas 784, 788. Antennas 784, 788 may be configured to transmit in different frequency bands and/or using different wireless communication protocols. The antennas 784, 788 may be directional, omnidirectional, or non-directional antennas. In addition to sending data, antennas 784, 788 may also receive data, which is sent to appropriate RF modules connected to the antennas.

In one embodiment, the user device 705 establishes a first connection using a first wireless communication protocol, and a second connection using a different wireless communication protocol. The first wireless connection and second wireless connection may be active concurrently, for example, if a user device is downloading a media item from a server (e.g., via the first connection) and transferring a file to another user device (e.g., via the second connection) at the same time. Alternatively, the two connections may be active concurrently during a handoff between wireless connections to maintain an active session (e.g., for a telephone conversation). Such a handoff may be performed, for example, between a connection to a WLAN hotspot and a connection to a wireless carrier system. In one embodiment, the first wireless connection is associated with a first resonant mode of an antenna structure that operates at a first frequency band and the second wireless connection is associated with a second resonant mode of the antenna structure that operates at a second frequency band. In another embodiment, the first wireless connection is associated with a first antenna element and the second wireless connection is associated with a second antenna element. In other embodiments, the first wireless connection may be associated with a media purchase application (e.g., for downloading electronic books), while the second wireless connection may be associated with a wireless ad hoc network application. Other applications that may be associated with one of the wireless connections include, for example, a game, a telephony application, an Internet browsing application, a file transfer application, a global positioning system (GPS) application, and so forth.

Though a modem 722 is shown to control transmission and reception via antenna (784, 788), the user device 705 may alternatively include multiple modems, each of which is configured to transmit/receive data via a different antenna and/or wireless transmission protocol.

The user device 705 delivers and/or receives items, upgrades, and/or other information via the network. For example, the user device 705 may download or receive items from an item providing system. The item providing system receives various requests, instructions and other data from the user device 705 via the network. The item providing system may include one or more machines (e.g., one or more server computer systems, routers, gateways, etc.) that have processing and storage capabilities to provide the above functionality. Communication between the item providing system and the user device 705 may be enabled via any communication infrastructure. One example of such an infrastructure includes a combination of a wide area network (WAN) and wireless infrastructure, which allows a user to use the user device 705 to purchase items and consume items without being tethered to the item providing system via hardwired links. The wireless infrastructure may be provided by one or multiple wireless communications systems, such as one or more wireless communications systems. One of the wireless communication systems may be a wireless local area network (WLAN) hotspot connected with the network. The WLAN hotspots can be created by products using the Wi-Fi® technology based on IEEE 802.11x standards by Wi-Fi Alliance. Another of the wireless communication systems may be a wireless carrier system that can be implemented using various data processing equipment, communication towers, etc. Alternatively, or in addition, the wireless carrier system may rely on satellite technology to exchange information with the user device 705.

The communication infrastructure may also include a communication-enabling system that serves as an intermediary in passing information between the item providing system and the wireless communication system. The communication-enabling system may communicate with the wireless communication system (e.g., a wireless carrier) via a dedicated channel, and may communicate with the item providing system via a non-dedicated communication mechanism, e.g., a public Wide Area Network (WAN) such as the Internet.

The user devices 705 are variously configured with different functionality to enable consumption of one or more types of media items. The media items may be any type of format of digital content, including, for example, electronic texts (e.g., eBooks, electronic magazines, digital newspapers, etc.), digital audio (e.g., music, audible books, etc.), digital video (e.g., movies, television, short clips, etc.), images (e.g., art, photographs, etc.), and multi-media content. The user devices 705 may include any type of content rendering devices such as electronic book readers, portable digital assistants, mobile phones, laptop computers, portable media players, tablet computers, cameras, video cameras, netbooks, notebooks, desktop computers, gaming consoles, DVD players, media centers, and the like.

In the above description, numerous details are set forth. It will be apparent, however, to one of ordinary skill in the art having the benefit of this disclosure, that embodiments may be practiced without these specific details. In some instances, well-known structures and devices are shown in block diagram form, rather than in detail, in order to avoid obscuring the description.

Some portions of the detailed description are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers or the like.

It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms such as "inducing," "parasitically inducing," "radiating," "detecting," determining," "generating," "communicating," "receiving," "disabling," or the like, refer to the actions and processes of a computer system, or similar electronic computing device, that manipulates and transforms data represented as physical (e.g., electronic) quantities within the computer system's registers and memories into other data similarly represented as physical quantities within the computer system memories or registers or other such information storage, transmission or display devices.

Embodiments also relate to an apparatus for performing the operations herein. This apparatus may be specially constructed for the required purposes, or it may comprise a general-purpose computer selectively activated or reconfigured by a computer program stored in the computer. Such a computer program may be stored in a computer readable storage medium, such as, but not limited to, any type of disk including floppy disks, optical disks, CD-ROMs and magnetic-optical disks, read-only memories (ROMs), random access memories (RAMs), EPROMs, EEPROMs, magnetic or optical cards, or any type of media suitable for storing electronic instructions.

The algorithms and displays presented herein are not inherently related to any particular computer or other apparatus. Various general-purpose systems may be used with programs in accordance with the teachings herein, or it may prove convenient to construct a more specialized apparatus to perform the required method steps. The required structure for a variety of these systems will appear from the description below. In addition, the present embodiments are not described with reference to any particular programming language. It will be appreciated that a variety of programming languages may be used to implement the teachings of the present invention as described herein. It should also be noted that the terms "when" or the phrase "in response to," as used herein, should be understood to indicate that there may be intervening time, intervening events, or both before the identified operation is performed.

It is to be understood that the above description is intended to be illustrative, and not restrictive. Many other embodiments will be apparent to those of skill in the art upon reading and understanding the above description. The scope of the present embodiments should, therefore, be determined with reference to the appended claims, along with the full scope of equivalents to which such claims are entitled.

What is claimed is:

1. An electronic device comprising:

a single radio frequency (RF) feed;

RF circuitry coupled to the single RF feed;

a metal cover comprising a middle strip element, a first corner ground element, and a second corner ground element disposed at a periphery of the metal cover, wherein the middle strip element is physically separated from the first corner ground element by a first cutout in the metal cover and the middle strip element is physically separated from the second corner ground element by a second cutout in the metal cover; and an antenna structure coupled to the RF feed, the antenna structure comprising a ground plane, a first antenna formed by a feeding element, the middle strip element and the first corner ground element, wherein:

the feeding element comprises:

a first section that extends from a feeding point at the RF feed in a first direction;

a second section that extends from a distal end of the first section in a second direction perpendicular to the first direction; and a third section that extends from a distal end of the second section in the first direction and couples to a first end of the middle strip element, wherein the middle strip element extends in the second direction; and the first corner ground element comprises:

a first section that extends from the ground plane in the first direction to form a first gap between the feeding element and the first corner ground element; and a second section that extends from a distal end of the first section of the first corner ground element in the second direction to form a second gap between the feeding element and the first corner ground element.

2. The electronic device of claim 1, wherein the antenna structure further comprises:

a second parasitic antenna formed by the second corner ground element and a ground line coupled between the second corner ground element and the ground plane; and a capacitor disposed between the feeding element and the first corner ground element at a distal end of the feeding element.

3. The electronic device of claim 1, further comprising proximity sensing circuitry coupled to the middle strip element via the feeding element, wherein the proximity sensing circuitry is operable to measure a capacitance of the middle strip element.

4. The electronic device of claim 1, wherein the RF circuitry comprises a wireless area network (WAN) module, wherein the WAN module is operable to cause the feeding element, the middle strip element and the first corner ground element to radiate electromagnetic energy in a first frequency range in a first resonant mode and a second resonant mode, and wherein the feeding element, the middle strip element and the first corner ground element are operable to cause the second corner ground element to radiate electromagnetic energy in a second frequency range in a third resonant mode.

5. An apparatus comprising:

a metal cover comprising a first corner portion, a second corner portion, and an elongated portion disposed between the first corner portion and the second corner portion, wherein the elongated portion is physically separated from the first corner portion by a first cutout in the metal cover and the elongated portion is physically separated from the second corner portion by a second cutout in the metal cover;

a radio frequency (RF) feed;

a RF circuit coupled to the RF feed;

a feeding element coupled to the RF feed at a feeding point and coupled the elongated portion at a distal end of the feeding element, the distal end being farthest from the feeding point; and a capacitor coupled between the feeding element and the first corner portion near the distal end of the feeding element, wherein the RF circuit is operable to cause the feeding element, the elongated portion, and the first corner portion to radiate electromagnetic energy as a first radiator in a first frequency range with dual resonance.

6. The apparatus of claim 5, wherein the first radiator is operable to cause the second corner portion to radiate electromagnetic energy in a second frequency range, the second frequency range being higher than the first frequency range.

7. The apparatus of claim 6, wherein the RF circuit comprises a wireless area network (WAN) module, wherein the WAN module is operable to cause the feeding element, the elongated portion and the first corner portion to radiate electromagnetic energy in the first frequency range in two resonant modes, and wherein the feeding element, the elongated portion and the first corner portion are operable to cause the second corner portion to radiate electromagnetic energy in the second frequency range in a third resonant mode.

8. The apparatus of claim 7, wherein the first frequency range is between approximately 770 MHz and approximately 1.0 GHz, and wherein the second frequency range is between approximately 1.7 GHz and 2.2 GHz.

9. The apparatus of claim 5, wherein the RF circuit is operable to apply a signal at the feeding point, wherein the signal causes a first current flow along the feeding element towards the elongated portion and causes a second current flow along the first corner portion towards the first cutout in the same direction as the first current flow.

10. The apparatus of claim 5, wherein the first cutout and the second cutout are disposed at symmetric locations on a first side of the apparatus relative to a center point on the first side.

11. The apparatus of claim 5, further comprising a proximity sensing circuit coupled to the feeding element, wherein the proximity sensing circuitry is operable to measure a capacitance of the elongated portion in a proximity sensing mode, and wherein the elongated portion is operable to radiate the electromagnetic energy in an antenna mode.

12. The apparatus of claim 11, further comprising a switch coupled to the RF circuit and the proximity sensing circuit, the switch to couple the RF circuit to the feeding element in the antenna mode and to couple the proximity sensing circuit to feeding element in the proximity sensing mode.

13. The apparatus of claim 5, wherein:

the feeding element comprises:

a first section that extends from the feeding point along a first path;

a second section that extends from a distal end of the first section along a second path; and a third section that extends from a distal end of the second section along a third path and couples to the elongated portion at a first end;

the elongated portion extends along a fourth path to a second end; and the first corner portion comprises:

a first section that extends along a fifth path that follows a direction of the first path to form a first gap between the feeding element and the first corner portion; and a second section that extends from a distal end of the first section of the first corner portion along a sixth path that follows a direction of the second path to form a second gap between the feeding element and the first corner portion.

14. The apparatus of claim 5, wherein the first corner portion is an L-shape that starts at a first side of the metal cover and bends to a second side, and wherein the first side and the second side of the metal cover are curved.

15. The apparatus of claim 14, further comprising a grounding line coupled between a distal end of the second corner portion and a grounding point at a ground plane, wherein the second corner portion is a second L-shape that starts at a third side of the metal cover and bends to the second side, wherein the third side of the metal cover is curved.

16. The apparatus of claim 5, further comprising an impedance matching circuit coupled to the feeding point, wherein the impedance matching circuit comprises:

a first capacitor coupled between the RF feed and an intermediate node;

a second capacitor coupled between the intermediate node and the feeding point; and an inductor coupled between the intermediate node and a ground potential.

17. A method comprising:

applying, by a radio frequency (RF) circuit, a signal to cause a first radiator to radiate electromagnetic energy in a first frequency range in a first mode, the first radiator comprising:

a feeding element coupled to an elongated portion of a metal cover of a user device;

a first corner portion of the metal cover;

an elongated portion of the metal cover, the elongated portion being coupled to a distal end of the feeding element, and the first corner portion separated from the elongated portion by a first cutout in the metal cover; and a capacitor is disposed between the first corner portion and the feeding element at a distal end of the feeding element, the signal to cause a first current to flow along the feeding element towards the elongated portion, and the capacitor to cause a second current to flow from a ground plane, around the first corner portion and towards the first cutout, the first current and the second current causing a dual resonance by the first radiator;

switching from the first mode to a second mode; and measuring, by a proximity sensing circuit, a capacitance of the elongated portion to detect an object proximate to the elongated portion in the second mode.

18. The method of claim 17, further comprising parasitically inducing a third current on a second radiator to radiate electromagnetic energy in a second frequency range in the first mode, the second radiator being a second corner portion of the metal cover with a grounding line coupled between a grounding point at the ground plane and a distal end of the second corner portion.

19. The method of claim 18, wherein the applying the signal comprises applying the signal from a wireless area network (WAN) module to cause the feeding element, the elongated portion and the first corner portion to radiate electromagnetic energy in the first frequency range in two resonant modes, and wherein the feeding element, the elongated portion and the first corner portion are operable to cause the second corner portion to radiate electromagnetic energy in the second frequency range in a third resonant mode.

20. The method of claim 19, wherein the first frequency range is between approximately 770 MHz and approximately 1.0 GHz, and wherein the second frequency range is between approximately 1.7 GHz and 2.2 GHz.

* * * * *